United States Patent [19]

Hurley et al.

[11] Patent Number: 4,573,502

[45] Date of Patent: Mar. 4, 1986

[54] CONTAINER FILLING APPARATUS AND METHOD

[75] Inventors: Byron H. Hurley, Julian; Walter G. Ricks, Pleasant Garden, both of N.C.

[73] Assignee: Byron H. Hurley, Pleasant Garden, N.C.

[21] Appl. No.: 658,669

[22] Filed: Oct. 9, 1984

[51] Int. Cl.[4] ..... B65B 3/04

[52] U.S. Cl. ..... 141/1; 141/232; 141/284

[58] Field of Search ..... 141/231-233, 141/270-284, 285-310, 318, 346-362, 367, 386-388, 390, 1-12

[56] References Cited

U.S. PATENT DOCUMENTS

| | | | |
|---|---|---|---|
| 3,924,666 | 12/1975 | Raison | 141/232 |
| 4,422,485 | 12/1983 | O'Shea et al. | 141/232 |
| 4,460,026 | 7/1984 | Hurley et al. | 141/1 |

*Primary Examiner*—Houston S. Bell, Jr.

[57] ABSTRACT

An apparatus and a method is presented for filling containers with liquids whereby one operator can quickly fill a number of containers uniformly in a fast and efficient manner. An adjustable electronic counter in communication with a programmable controller determines the amount of liquid which is directed into each container by receiving pulses from a pulse generator and a boom carriage and main support frame allow the filling assembly to be positioned over various nearby containers without the necessity of moving the containers for filling once they are placed in close proximity to the apparatus.

11 Claims, 5 Drawing Figures

CONTAINER FILLING APPARATUS AND METHOD

BACKGROUND OF THE INVENTION

1. Field of The Invention

This invention relates to an improved device and method for filling containers with liquid compositions by manual movement of the filling assembly from one container to another to allow a predetermined amount of liquid to flow into each container.

2. Description of the Prior Art And Objectives Of The Invention

Various types of automatic liquid filling devices have been developed over the years with emphasis most often placed on automatically moving the containers along a conveyor generally for long production runs when hundreds or more container are required. Such devices are often precisely designed to fill the container within an ounce or less variation as set forth in our former U.S. Pat. No. 4,460,026 issued July 17, 1984.

Oftentimes small batches of liquids such as cola syrups, oils, chemical compositions, distilled water and other products are needed requiring only a dozen or less containers and many times plant employees are required to fill such small numbers of containers by hand or else waste valuable time and money scheduling small runs on the larger, high capacity filling equipment.

In order to provide manufacturing operations with short run filling equipment the present invention was conceived and one of its objectives is to provide a filling apparatus and method which can be utilized by a single employee for relatively small production batches.

It is another objective of the present invention to provide filling apparatus to deliver a predetermined amount of liquid, said predetermined amount being simply and quickly adjustable.

It is still another objective of the present invention to provide filling apparatus which is relatively inexpensive to manufacture and which can be changed from one liquid to another without contamination, within a relatively short time.

It is yet another objective of the present invention to provide filling apparatus in which one relatively unskilled employee can operate fast and efficiently with uniform results.

Other objectives and advantages of the present invention will become apparent to those skilled in the art as the details of the invention are presented in more detail below.

SUMMARY OF THE INVENTION

A container filling apparatus and method is presented which allows a single operator to predetermine an amount of liquid to be dispensed to each container and to thereafter fill a number of containers in a fast and efficient manner. The apparatus of the invention comprises a main support frame and a support frame boom which can be rolled along the main support frame from side to side. A boom carriage is positioned on the support frame boom which can be rolled along the boom to a desired position. The support frame boom is mounted perpendicular to the main support frame thereby allowing the filling assembly on the boom carriage to be moveably positionable over a large variety of containers which may be placed, for example on the floor in rows and columns near the main support frame. The operator can place a series of palletized containers close to the filling apparatus with a pallet lift and by operating a pull switch after positioning the filling assembly over the selected container activate a brake piston which prevents the boom carriage from moving along the support frame boom during filling. The filling assembly includes a filler tube which is joined to an elevator which descends to lower the filler tube into the container to an adjustable depth. At the bottom of the descent a switch is actuated which opens the fill valve and allows the liquid to be pumped through the filler tube into the container. The elevator rises as the liquid enters the container and continues until the elevator reaches its maximum height. At the upper limit of the path of the elevator a second switch is acutuated which releases the brake and the filling assembly can then be moved to another container where the cycle can be repeated. The fill valve is closed stopping the liquid flow during the upward movement of the filling assembly when a pulse generator (turbine meter) sends the required number of pulses to a counter which is in communication with a programmable controller. A centrifugal pump is employed to pump the liquid from a nearby holding tank through the filler tube.

DESCRIPTION OF THE PREFERRED EMBODIMENTS

The filling apparatus presented in its preferred form includes a main support frame constructed from stainless steel which is approximately nine (9) feet wide. A support frame boom approximately six (6) feet long, also formed from stainless steel is perpendicularly mounted on rollers to said main support frame and can be rolled from side to side. A boom carriage also rollably mounted is positioned on the support frame boom and allows the elevator on which the filling assembly or means is positioned to move up and down. The filling assembly includes a filler tube, an air cylinder positioned on top of said filler tube and a fill valve which is operated by the air cylinder. A centrifugal pump forces the liquid into the filler tube during the filling operation. An air compressor supplies air to 4-way solenoid valves which operate air cylinders. The solenoid valves are in turn operated by a programmable controller such as as Model 510 Programmable Controller of Texas Instruments, Inc. The programmable controller is powered by a conventional 110 volt A.C. power source and joined thereto is an electronic counter such as a Model SCD manufactured by Red Lion Controls of York, Penn. Signals are received by the controller from magnetic reed limit switches adjustably positioned at the top and bottom of the elevator cylinder and also by a manually operated conventional limit switch which is used to begin the filling cycle. The electronic counter receives pulses from a pulse generator (turbine meter) such as manufactured by Accurate Metering Systems of Elk Grove Village, Ill. which is mounted within the liquid flow and when the counter receives a predetermined number of pulses which is adjustable by control dials on the counter, the counter signals the controller whereby the controller signals a 4-way solenoid valve assembly that closes the fill valve located at the bottom or terminal end of the filler tube by causing the air cylinder piston rod joined thereto to retract.

The preferred method of the invention comprises positioning the filling assembly or means over a container, manually activating the limit switch thereby lowering the filling means into the desired container after which the liquid is directed into the container while pulses are sent to the counter. As the liquid flows into the container the filling means rises and the liquid flow ceases when the counter receives a predetermined number of pulses.

DETAILED DESCRIPTION OF THE DRAWINGS

Figure 1:
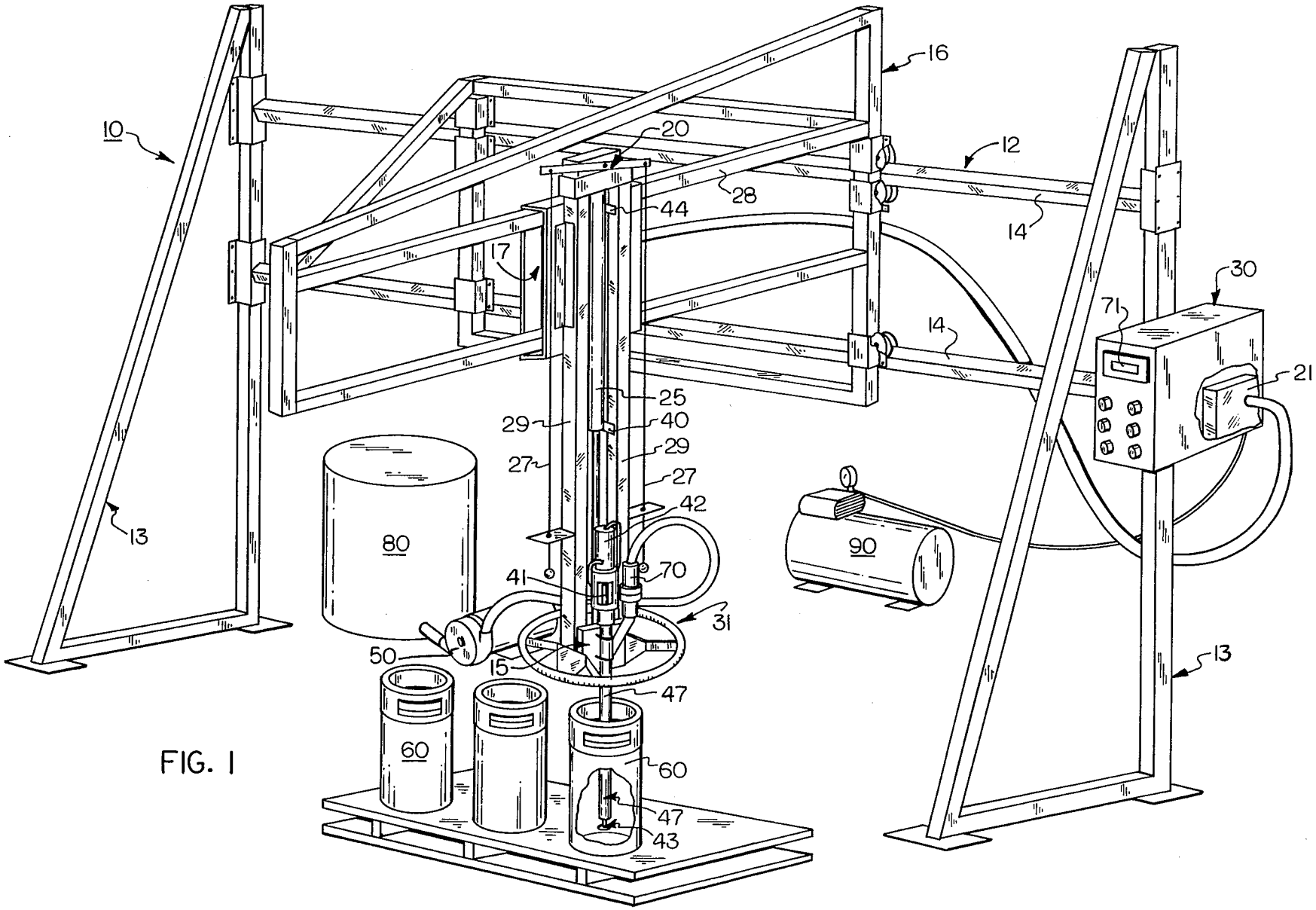
FIG. 1 is a right side perspective view of the filling apparatus.

Container filling apparatus 10 as shown in FIG. 1 is generally constructed of stainless steel and includes a main support frame 12 having a pair of triangular-shaped end supports 13 joined by the lateral support members 14. Support frame boom 16 is rollably positioned on main support frame 12 and can be moved along lateral support members 14 as required during the filling operation. Boom carriage 17 is rollable along support frame boom 16 as illustrated in an enlarged fashion in FIG. 3.

Figure 2:
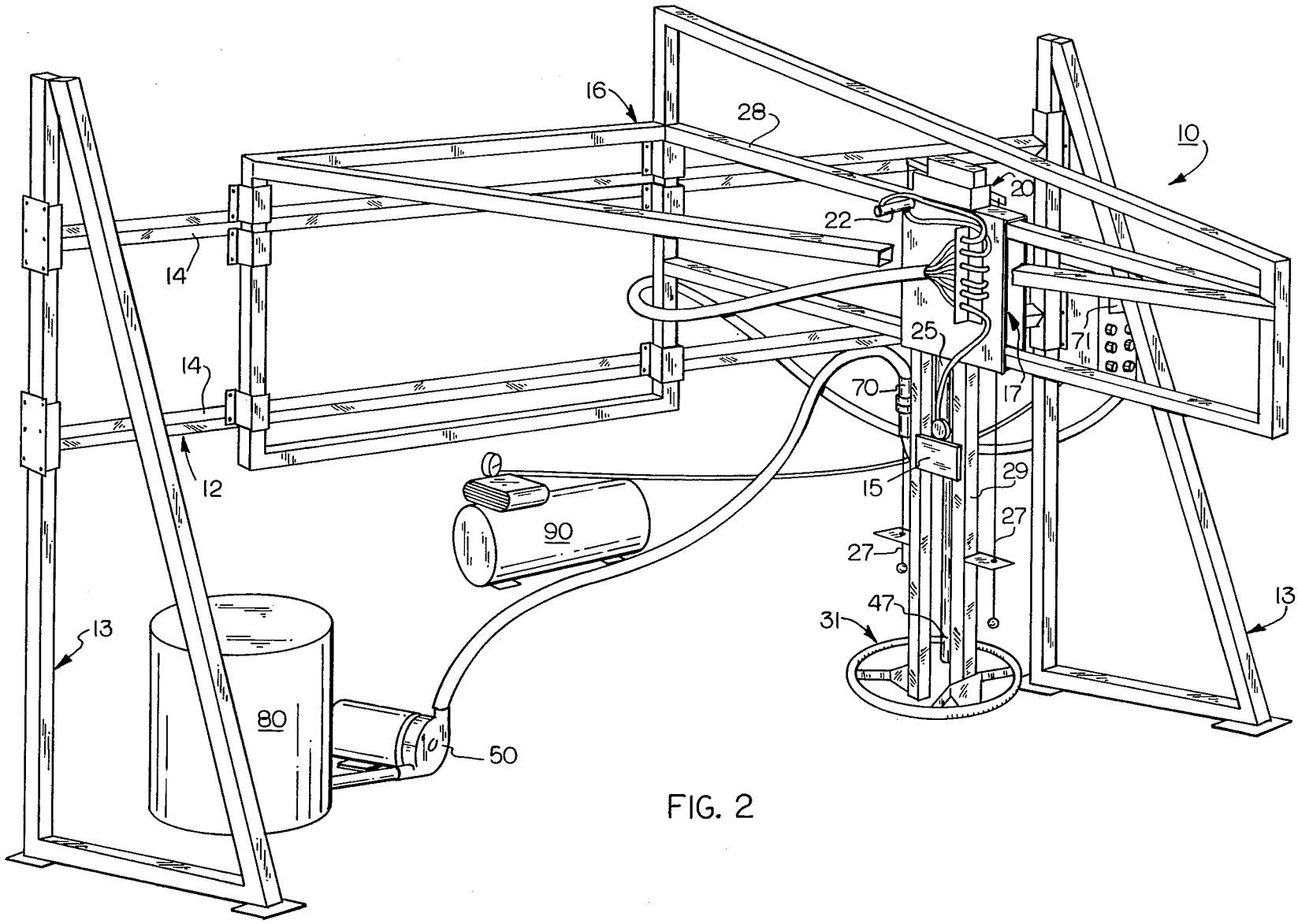
FIG. 2 is a left side perspective view of the apparatus as shown in FIG. 1.
Figure 3:
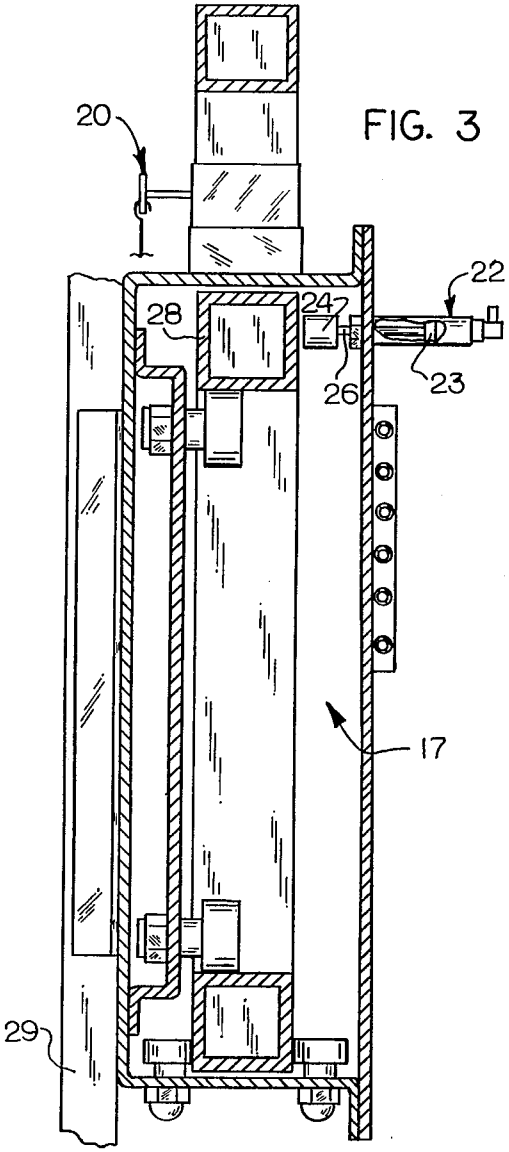
FIG. 3 is a cross sectional end view of the boom carriage.

The filling cycle begins by operating pull switch 20 of container filling apparatus 10 as shown in FIG. 1 which is a conventional limit switch having left and right pull rods 27 connected thereto. Pull switch 20 sends a signal to controller 30 which may be for example a Model 510 Texas Instruments solid state programmable controller which in turn sends a signal to valve assembly 21 which includes four (4) 4-way solenoid valves which allows air to flow into air cylinder 22 (FIG. 2) causing brake piston rod 26 as shown in FIG. 3 to extend. Brake pad 24 is attached to the terminal end of piston rod 26 of brake piston 23 and with the extension of brake piston rod 26, brake pad 24 engages boom frame member 28 and boom carriage 17 is then secured at the desired location along support frame boom 16 by brake pad 24 during the filling process of that particular container. Valve assembly 21 also allows air to flow to air cylinder 25 (FIG. 1) which causes elevator 15 to begin its descent along elevator support post 29. Elevator 15 slidably descends until magnetic reed switch 40 is closed upon extension of the piston rod of air cylinder 25 whereupon a signal is sent to controller 30. Controller 30 then signals valve assembly 21 and valve assembly 21 then allows air to flow to air cylinder 42 causing air cylinder piston rod 41 to extend thereby opening fill valve 43 positioned at the bottom of filler tube 47 (FIG. 2).

Pump 50, also shown in FIG. 2 which may be for example an electric one-half power centrifugal pump, forces liquid from holding tank 80 into filler tube 47 and out of fill valve 43 into container 60 positioned below. The liquid which is being pumped, for example a cola syrup, oil, distilled water or other liquid travels through turbine meter 70 shown in FIG. 1, which may for example have a 25 gallon per minute rating and which generates pulses to signal counter 71 contained within and in communication with programmable controller 30. As would be understood, elevator 15 is directed to rise simultaneously with the opening of fill valve 43 by the action of air cylinder 25.

Counter 71 when reaching a predetermined (adjustable) number of pulses received, signals controller 30 which in turn causes valve assembly 21 to close fill valve 43 by the action of air cylinder 42 shutting off the fluid flow. Elevator 15 continues its rise until second magnetic reed switch 44 is actuated (FIG. 1) which, upon actuation forwards a signal to controller 30 which in turn signals valve assembly 21 thereby causing brake piston rod 26 to retract and also causes the piston within air cylinder 25 to stop its inward motion thus releasing brake pad 24 from boom frame member 28. The operator can then manually direct boom carriage 17 to another location along support frame boom 16 by circular guide ring 31 and begin the filling cycle again by operating pull switch 20.

Figure 4:
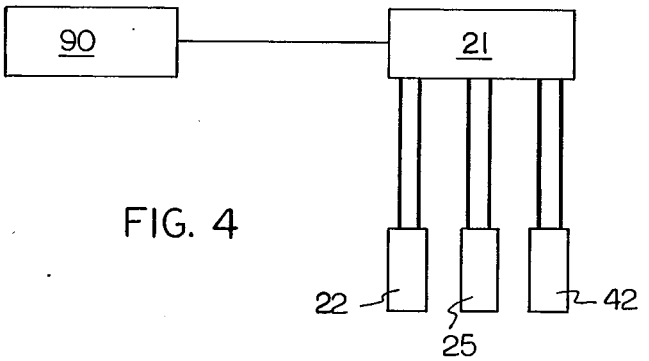
FIG. 4 is a schematic view of the pneumatic apparatus of the invention.

FIG. 4 illustrates in schematic fashion the pneumatic apparatus involved in which air compressor 90 provides a source of compressed air to valve assembly 21. Valve assembly 21 allows air to open or close air cylinders 22, 25 and 42 as directed by programmable controller 30.

Figure 5:
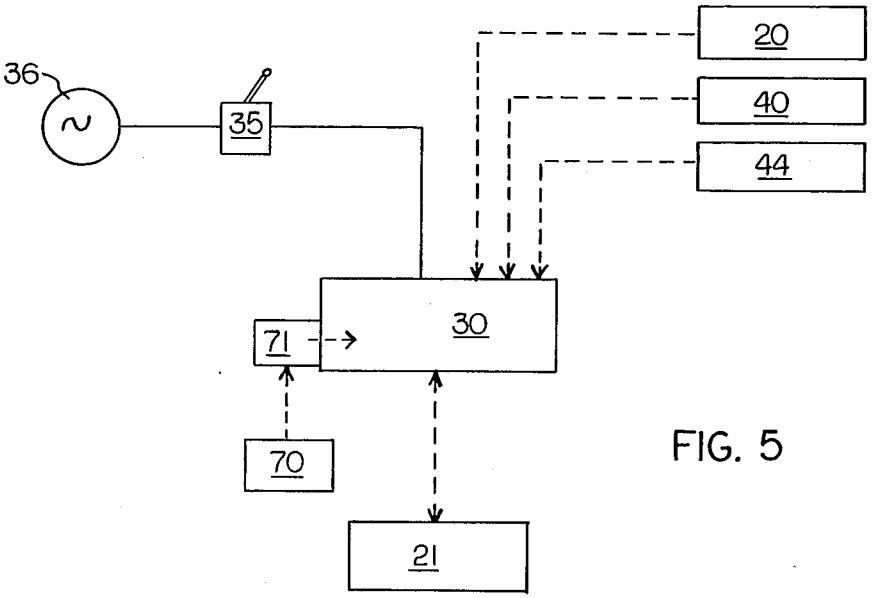
FIG. 5 is a schematic view of the electrical components.

Programmable controller 30 is schematically shown in FIG. 5 in which pulse counter 71 is in communication therwith. Programmable controller 30 is operated by turning on manual switch 35 which is connected to a conventional 110 volt A.C. source 36. Turbine meter 70 sends pulses to counter 71 which in turn signals controller 30 which operates valve assembly 21 to control fill valve 43. Also shown in FIG. 5 are pull switch 20 and magnetic reed switches 40 and 44 which are in communication with programmable controller 30 as explained above.

The illustrations and examples presented are for explanatory purposes and are not intended to limit the scope of the claims.

We claim:

1. Apparatus for filling a container comprising: a support frame, a boom, said boom adjustably positionable on said frame, a boom carriage, said carriage movable along said boom, an elevator, said elevator mounted on said boom carriage, filling means, said filling means having a filler tube, a supply tank, said supply tank joined to said filler means, said filling means positioned on said elevator, switch means, a programmable controller, said switch means for activating said controller, said controller communicating with said elevator, brake means, said brake means joined to said boom carriage and communicating with said controller whereby upon activation of said switch means said controller causes said brake means to engage said boom and said elevator to decend allowing said filler tube to be lowered into a container for filling from said supply tank.

2. Apparatus as claimed in claim 1 wherein said filler tube has a terminal fill valve.

3. Apparatus as claimed in claim 1 and including a centrifugal pump, said pump communicating with said filling means and with said supply tank.

4. Apparatus as claimed in claim 2 and including a turbine meter, said meter joined to said filler tube.

5. Apparatus as claimed in claim 1 and including an electronic counter, said counter in communication with said controller.

6. Apparatus for filling a container comprising: a support frame, a boom, said boom adjustably positioned on said frame, a boom carriage, said carriage movable along said boom, an elevator, said elevator mounted on said boom carriage, a filling means, said filling means including a filler tube having a terminal fill valve, a turbine meter, said turbine meter joined to said filler tube, pump means, said pump means communicating with said turbine meter, switch means, a programmable controller, said switch means for activating said controller, said controller communicating with said elevator, brake means, said brake means joined to said boom carriage and communicating with said controller wherby upon activation of said switch means said controller causes said brake means to engage said boom and said elevator to descend allowing said filler tube to be lowered into a container for filling from said supply tank.

7. A method of filling a container with liquid comprising: positioning filling means over a container, manually activating a switch, setting brake means while lowering said filling means into the container, directing liquid into the container from the filling means, sending a pulse to a counter while directing the liquid into the container and raising said filling means while directing the liquid into the container.

8. A method of filling a container as claimed in claim 7 wherein positioning a filling means over a container comprises manually positioning said filling means over a container.

9. A method of filling a container as claimed in claim 7 wherein lowering the filling means comprises lowering an elevator.

10. A method of filling a container as claimed in claim 7 wherein directing liquid into a container comprises opening a fill valve by an air cylinder.

11. A method of filling a container with liquid comprising: positioning filling means over a container manually, manually activating a switch, setting a brake means, lowering said filling means into the container, directing liquid into the container from the filling means while sending a pulse to a counter from a turbine meter, raising the filling means while directing the liquid into the container, terminating the liquid flow upon said counter receiving a predetermined number of pulses and releasing the brake means.

* * * * *